US010036609B1

(12) United States Patent
Rojas Garcia

(10) Patent No.: US 10,036,609 B1
(45) Date of Patent: Jul. 31, 2018

(54) FIREARM GRIP

(71) Applicant: Dan Paul Rojas Garcia, Panorama City, CA (US)

(72) Inventor: Dan Paul Rojas Garcia, Panorama City, CA (US)

( * ) Notice: Subject to any disclaimer, the term of this patent is extended or adjusted under 35 U.S.C. 154(b) by 0 days.

(21) Appl. No.: 15/857,311

(22) Filed: Dec. 28, 2017

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/02; F41C 23/10; F41C 23/12; F41C 23/14; F41C 27/00; F41C 33/006; F41C 33/007
USPC ..... 42/71.01, 71.02, 75.01–75.03, 85, 106
See application file for complete search history.

(56) References Cited

U.S. PATENT DOCUMENTS 5,726,377 A * 3/1998 Harris ..... F41A 19/14 42/65
D410,988 S * 6/1999 Hines ..... D22/100
D439,948 S * 4/2001 Fletcher ..... D22/100
D559,345 S * 1/2008 Wayne ..... D22/108
D574,054 S * 7/2008 Early, IV ..... D22/108
8,601,734 B1 * 12/2013 Hopkins ..... F41C 23/14 42/71.01
D700,943 S * 3/2014 Cottle ..... D22/108
D701,281 S * 3/2014 Cottle ..... D22/108
8,769,854 B1 * 7/2014 Battaglia ..... F41A 3/66 42/71.01
D716,405 S * 10/2014 Storey ..... D22/108
D717,903 S * 11/2014 Prince ..... D22/108
D732,136 S * 6/2015 Webber ..... D22/108
D734,418 S * 7/2015 Hines ..... D22/108
D735,832 S * 8/2015 Fitzpatrick ..... D22/108
9,441,910 B1 * 9/2016 Fogoros ..... F41C 23/14
9,599,429 B1 * 3/2017 Davis ..... F41C 23/14
9,612,082 B2 * 4/2017 Cottle ..... F41C 23/14
9,823,042 B2 * 11/2017 Thordsen ..... F41C 23/14
9,851,175 B2 * 12/2017 Leasure ..... F41C 23/16
9,885,538 B2 * 2/2018 Davis ..... F41C 23/10
D812,181 S * 3/2018 Hartley ..... D22/109
2003/0140542 A1 * 7/2003 Kay ..... F41C 23/16 42/75.03
2009/0126249 A1 * 5/2009 Crommett ..... F41A 11/02 42/71.01
2010/0162608 A1 * 7/2010 McCann ..... F41C 23/14 42/71.01
2011/0283583 A1 * 11/2011 Freed ..... F41C 23/14 42/71.01

(Continued)

*Primary Examiner* — Joshua E Freeman
(74) *Attorney, Agent, or Firm* — Lowry Blixseth LLP

(57) ABSTRACT

The firearm grip includes a front section having a width forming a connection assembly that includes a slot positioned between a pair of laterally extending guides. The connection assembly has a size and shape for select removable coupling with a portion of a firearm. The firearm grip also includes a handle extending rearwardly relative to the front section and includes an upper palm receiving edge positioned above an opening of a trigger guard of the firearm when the firearm grip is selectively coupled thereto. The handle has a thickness relatively thinner than the width of the front section. Moreover, a tapered transition positioned between the front section and the handle generally decreases the width of the front section to the relatively thinner thickness of the handle.

23 Claims, 9 Drawing Sheets

(56) References Cited

U.S. PATENT DOCUMENTS

| | | | | |
|---|---|---|---|---|
| 2013/0091751 | A1* | 4/2013 | Barney | F41C 23/10<br>42/71.01 |
| 2013/0125442 | A1* | 5/2013 | Burress, Jr. | F41C 23/16<br>42/71.01 |
| 2013/0239450 | A1* | 9/2013 | Michel | F41C 23/14<br>42/73 |
| 2013/0340312 | A1* | 12/2013 | Fulton | F41C 23/14<br>42/73 |
| 2014/0144060 | A1* | 5/2014 | Thordsen | F41C 23/20<br>42/73 |
| 2014/0259850 | A1* | 9/2014 | Schreckenstein | F41C 23/12<br>42/75.03 |
| 2015/0000171 | A1* | 1/2015 | Roberts | F41A 3/66<br>42/75.03 |
| 2015/0300774 | A1* | 10/2015 | Wheaton | F41C 23/12<br>42/72 |
| 2016/0003576 | A1* | 1/2016 | Spykerman | F41C 23/14<br>42/73 |
| 2017/0191791 | A1* | 7/2017 | Davis | F41C 23/14 |
| 2017/0363385 | A1* | 12/2017 | Saadon | F41C 23/14 |
| 2018/0120054 | A1* | 5/2018 | Thordsen | F41A 35/06 |

* cited by examiner

FIREARM GRIP

BACKGROUND OF THE INVENTION

The present invention generally relates to a firearm grip. More specifically, the present invention relates to a firearm grip that selectively couples to a trigger assembly of a semi-automatic rifle and has a thickness that tapers inwardly and away therefrom to reduce palm pressure while simultaneously positioning the webbing of the hand above an opening of the trigger guard during operation.

Firearm grips are known in the art to have a variety of sizes, shapes, and constructions. In general, such firearm grips may permanently or selectively removably attach to a receiver assembly and may be designed to enhance comfort and usability of the firearm. For example, some firearms may be designed for use with a pistol grip designed to generally orient the hand that operates the trigger in a forward vertical orientation. Although, over the years, Congress has attempted to regulate, restrict, and even prohibit the use of pistol grips for use with personal firearms, such as by way of the National Firearms Act. In another example, rifles may include a grip that protrudes below the body of the rifle and that otherwise does not integrate with the shoulder stock (i.e., part of a thumbhole stock). Such rifle grips are similarly regulated in some states and were previously regulated by the now-expired Federal Assault Weapons Ban.

Accordingly, to comply with state and federal gun laws in the United States (e.g., to reduce the capability of operating a rapid-fire or semi-automatic firearm), some firearm grips are designed to bias the webbing of the hand away from (e.g., above) a trigger guard. Such grips may include a generally triangular shape to position the hand in a relatively horizontal and elevated position, as opposed to a forward and generally vertical position as with many pistol grips. Ideally, the general purpose of the firearm grip is to ergonomically position the hand to operate the firearm, including providing convenient and comfortable access to the trigger. For example, on the AR-15 and M16 rifle, a right-handed user's index finger can control the trigger and magazine release, while the thumb can control the safety or fire mode selector switch, all without needing to remove the palm from the grip. But, elevating the webbing of the hand to sit above the trigger guard to comply with federal and state laws can be particularly uncomfortable since the user must spread open the palm of their hand to wrap around the width or thickness of the firearm grip, which is oftentimes at least the width of the rifle itself. This, in turn, increases the amount of pressure on the palm of the hand. Moreover, the portion of the rifle grip directly under the arch of the receiver is also relatively wide, which adds additional uncomfortable pressure on the index finger and thumb and forces the hand into a U-shape that places yet additional uncomfortable pressure on the first joint of the thumb when wrapping the hand around the grip. Accordingly, such a configuration generates hand soreness, especially after prolonged use One such product known in the art is the Liberal Rifle Grip manufactured by Featureless Arms of Monterrey, Calif. Specifically, the Liberal Rifle Grip is designed to prevent the web of the trigger hand from being placed below the top of the exposed trigger when firing. In this respect, the portion of the rifle grip that connects to the firearm and extends away therefrom includes a generally consistent thickness or width. To this end, the rifle grip can be uncomfortable to hold, and especially after prolonged use, since the relatively consistent width grip increases palm pressure as the user must stretch more of the hand webbing around the thickness of the rifle grip to maintain operational control thereof. To compensate for the hand stretch, the Liberal Rifle Grip includes a ribbed front strap and textured palm wells that provide for additional outward or positive contact.

Additional firearm grips known in the art include the AR-15 Gear and AK-47/SKM Gear firearm grips manufactured and sold by Resurgent Arms, LLC of 788 8th Avenue, Apt. 3, San Francisco, Calif. 94118 (collectively "Resurgent Arms Grips"). Although, similar to the Liberal Rifle Grip, the Resurgent Arms Grips couple to the trigger assembly of a rifle and include a generally consistent or continuous thickness extending rearwardly therefrom. Moreover, the Resurgent Arms Grips go one step further by including an upper rear surface having a textured and curved geometry which biases the palm outwardly to provide some clearance for the hand to move into position and to provide a shelf for the middle finger. Again, increasing the thickness of the firearm grip, even if to provide additional texturing or positive contact, stretches the hand and webbing, and can be uncomfortable after pro-longed use.

There exists, therefore, a need in the art for a firearm grip that couples to a trigger assembly and tapers rearwardly therefrom to reduce palm pressure thereon during use. The present invention fulfills these needs and provides further related advantages.

SUMMARY OF THE INVENTION

On embodiment of a firearm grip as disclosed herein includes a front section having a width forming a connection assembly that includes a slot positioned between a pair of laterally extending guides. The connection assembly may have a size and shape for select removable coupling with a portion of a firearm. The firearm grip also includes a handle having a thickness relatively thinner than the width of the front section and extending rearwardly relative to the front section, the handle including an upper palm receiving edge positioned above an opening of a trigger guard of the firearm when the firearm grip is selectively coupled thereto. Moreover, a tapered transition is positioned between the front section and the handle. The tapered transition generally decreases the width of the front section to the relatively thinner thickness of the handle.

During slotted engagement of the firearm grip with the firearm, the pair of lateral guides sandwich a downwardly extending flange of the firearm within the slot and cooperate therewith to prevent side-to-side movement of the firearm grip relative to the firearm. At least one of the pair of lateral guides may include a threaded aperture having a size and shape for select threaded engagement with a fastener for securing the firearm grip to the firearm. Moreover, the slot may include an internally positioned angled platform for select ramp-up engagement with a keyed base of the firearm. Here, the angled platform may terminate internally within the slot into a generally vertically positioned stop positioning the firearm grip in flush relation relative to the firearm.

The firearm grip may also include an upstanding collar vertically positioned above the upper palm receiving edge of the handle. Here, the upstanding collar may include an outer wall flush with an outer wall of the front section, the tapered transition, and the relatively thinner thickness of the handle. In one embodiment, the collar has a relatively consistent wall thickness and opposite sides of the upstanding collar proximate the front section start in spaced relation relative to one another and extend rearwardly and inwardly and terminate in a common point thereby forming a general V-shaped enclosure. The common point forms a generally upstanding hand stop positioned vertically above the upper palm receiving edge of the handle.

In another aspect of this embodiment, an outer wall of the tapered transition may include a curved outer wall that generally decreases in size from the width of the front section to the relatively thinner thickness of the handle. Moreover, the upper palm receiving edge may include a filleted surface and the handle may be hollow or solid.

In another embodiment, the firearm grip includes a front section having a width forming a connection assembly having a size and shape for select coupling with a firearm. A handle having a thickness relatively thinner than the width of the front section extends rearwardly from the front section. A tapered transition positioned between the front section and the handle includes a curved outer wall generally decreasing the width of the front section to the relatively thinner thickness of the handle. Moreover, in this embodiment, the firearm grip also includes an upstanding collar vertically positioned above a palm receiving edge of the handle and includes an outer wall flush with an outer wall of the front section, flush with the curved outer wall of the tapered transition, and flush with an outer wall of the relatively thinner thickness of the handle.

In another aspect of this embodiment, the connection assembly may include a slot having an angled platform positioned between a pair of laterally extending guides that sandwich a downwardly extending flange of the firearm within the slot and cooperate therewith to prevent side-to-side movement of the firearm grip relative to the firearm when coupled thereto. Here, the angled platform may terminate internally within the slot into a generally vertically positioned stop positioning the firearm grip in keyed flush relation relative to the firearm to align a threaded aperture within at least one of the pair of lateral guides with the firearm for select reception and coupling thereto by a threaded fastener. The handle itself may be solid and the upper palm receiving edge may include a filleted surface to enhance comfort.

Moreover, opposite sides of the upstanding collar proximate the front section may start in spaced relation relative to one another and extend rearwardly and inwardly and terminate in a common point forming a generally upstanding hand stop vertically positioned above the upper palm receiving edge of the handle. The upper palm receiving edge may then be positioned above an opening of a trigger guard of the firearm when the firearm grip is selectively coupled thereto.

In another alternative embodiment, the firearm grip includes a front section having a width forming a connection assembly that includes a slot having an internally positioned angled platform for select ramp-up engagement with a keyed base of a firearm positioned between a pair of laterally extending guides, one of which includes a threaded aperture having a size and shape for select threaded engagement with a fastener, and a solid handle extending rearwardly relative to the front section and including an upper palm receiving edge positioned above an opening of a trigger guard of the firearm when the firearm grip is selectively coupled thereto, the handle having a thickness relatively thinner than the width of the front section.

In this embodiment, during slotted engagement of the firearm grip with the firearm, the pair of lateral guides sandwich the keyed base within the slot and cooperate therewith to prevent side-to-side movement of the firearm grip relative to the firearm and the angled platform terminates internally within the slot into a generally vertically positioned stop positioning the firearm grip in flush relation relative to the firearm. An upstanding collar having a relatively consistent wall thickness vertically positioned above the upper palm receiving edge of the handle may have a filleted surface and an outer wall flush with an outer wall of the front section and the relatively thinner thickness of the handle, wherein opposite sides of the upstanding collar proximate the front section start in spaced relation relative to one another and extend rearwardly and inwardly and terminate in a common point thereby forming a general V-shaped enclosure.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
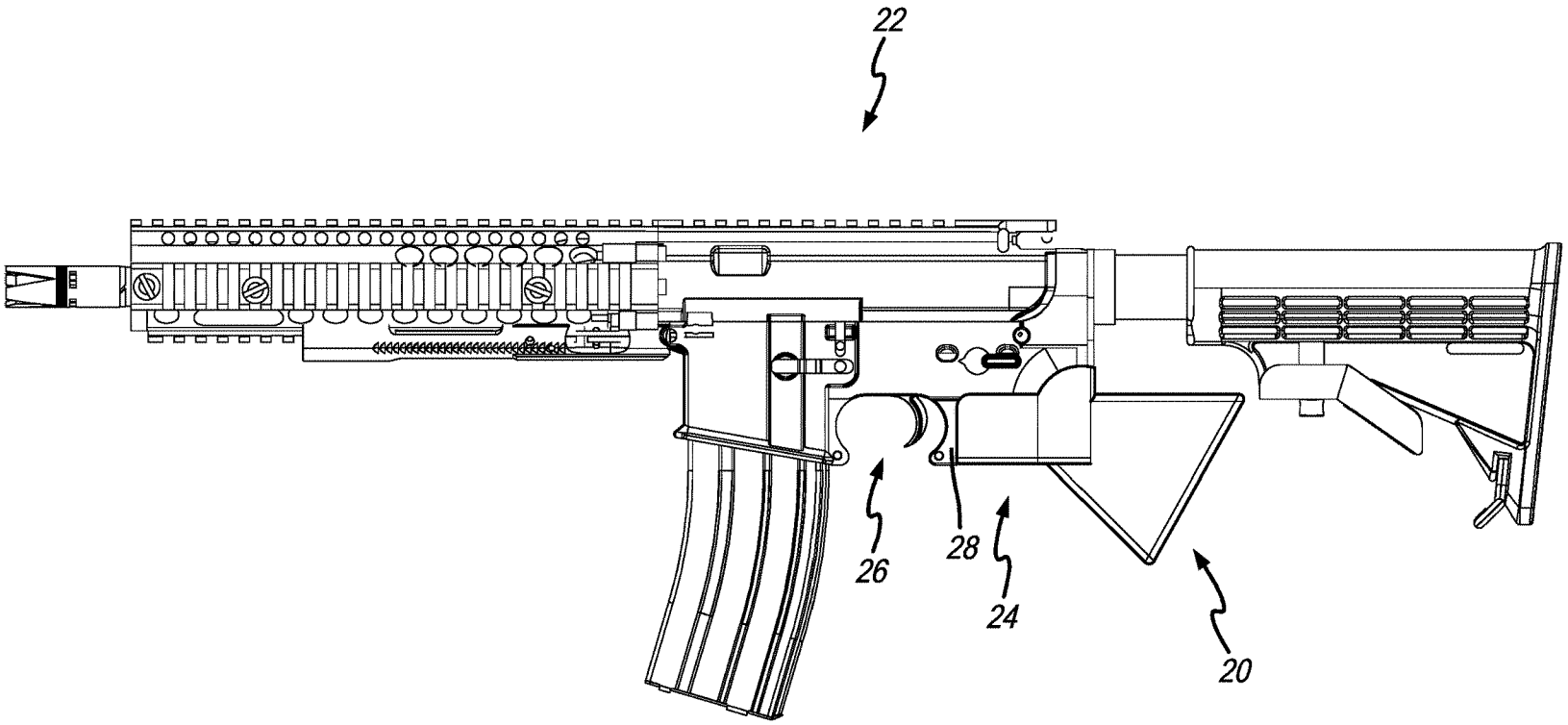
FIG. 1 is a side view of a rifle incorporating a firearm grip as disclosed herein.
Figure 2:
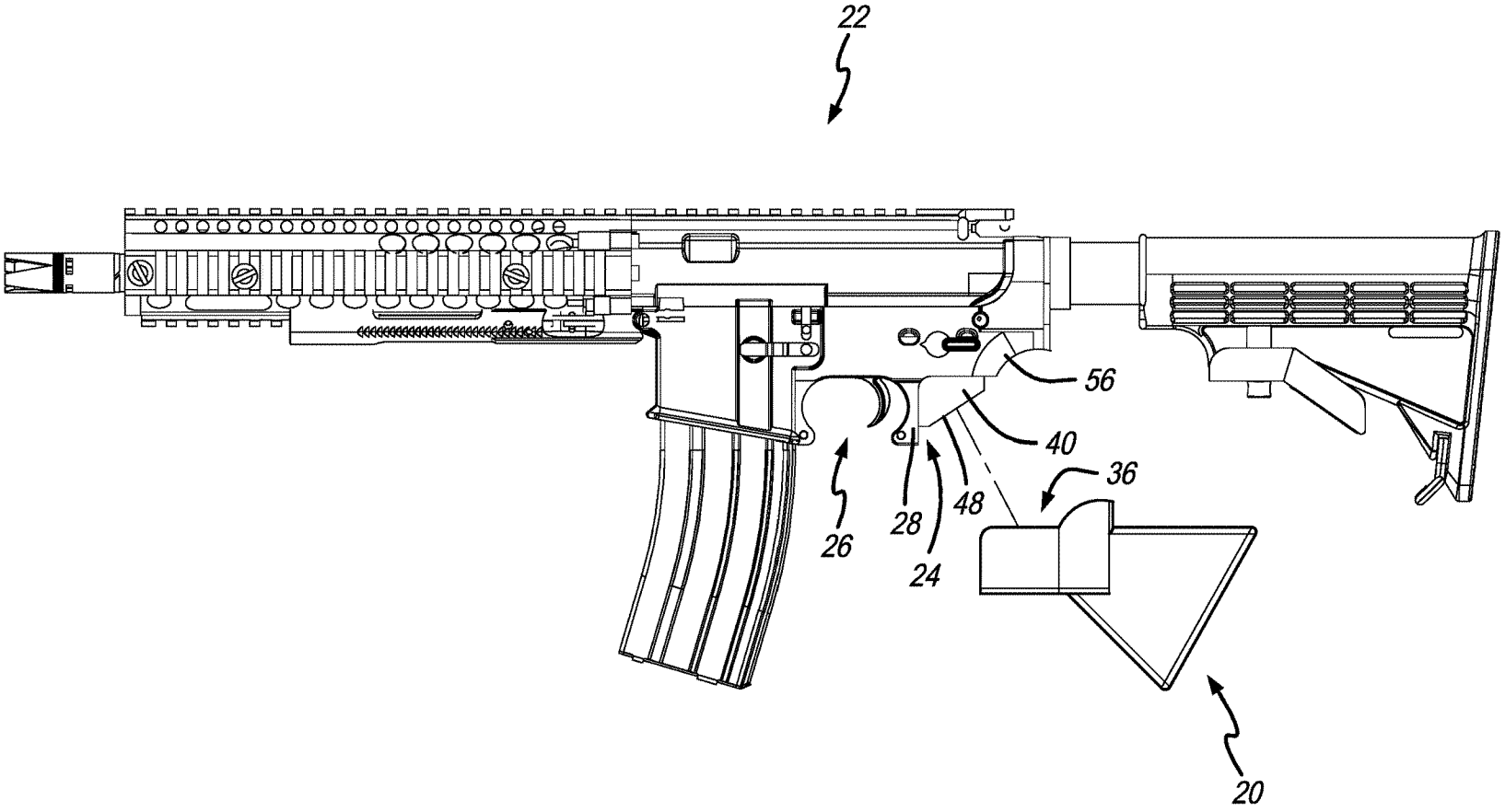
FIG. 2 is a side view similar to FIG. 1, further illustrating the firearm grip in exploded relation relative to the rifle.

As shown in the exemplary drawings for purposes of illustration, the present invention for a firearm grip is referred to herein with respect to reference numeral 20 in each of FIGS. 1-11. In general, as illustrated in FIG. 1 and the exploded perspective view of FIG. 2, the firearm grip 20 may selectively attach to a rifle 22 (e.g., a AR-15 rifle or the like). In general, the firearm grip 20 as disclosed herein allows the webbing of the hand to be placed higher than an opening 26 of a trigger guard 28 which, when combined with other modifications of the AR-15 type rifle, allows the user to remain compliant with state (e.g., California) and federal gun control laws, without sacrificing comfort. Thus, the firearm grip 20 is designed to have an angle similar to that of a standard pistol grip to allow for a natural feel and to reduce wrist pressure when shouldering the rifle 22. The firearm grip 20 may be specifically made for mil-spec AR-15 lower receiver assemblies (including the receiver assembly 24 illustrated in FIGS. 1 and 2) and may work with pinned collapsible stocks or fixed stocks that expose the buffer tube to allow enough clearance.

Figure 3:
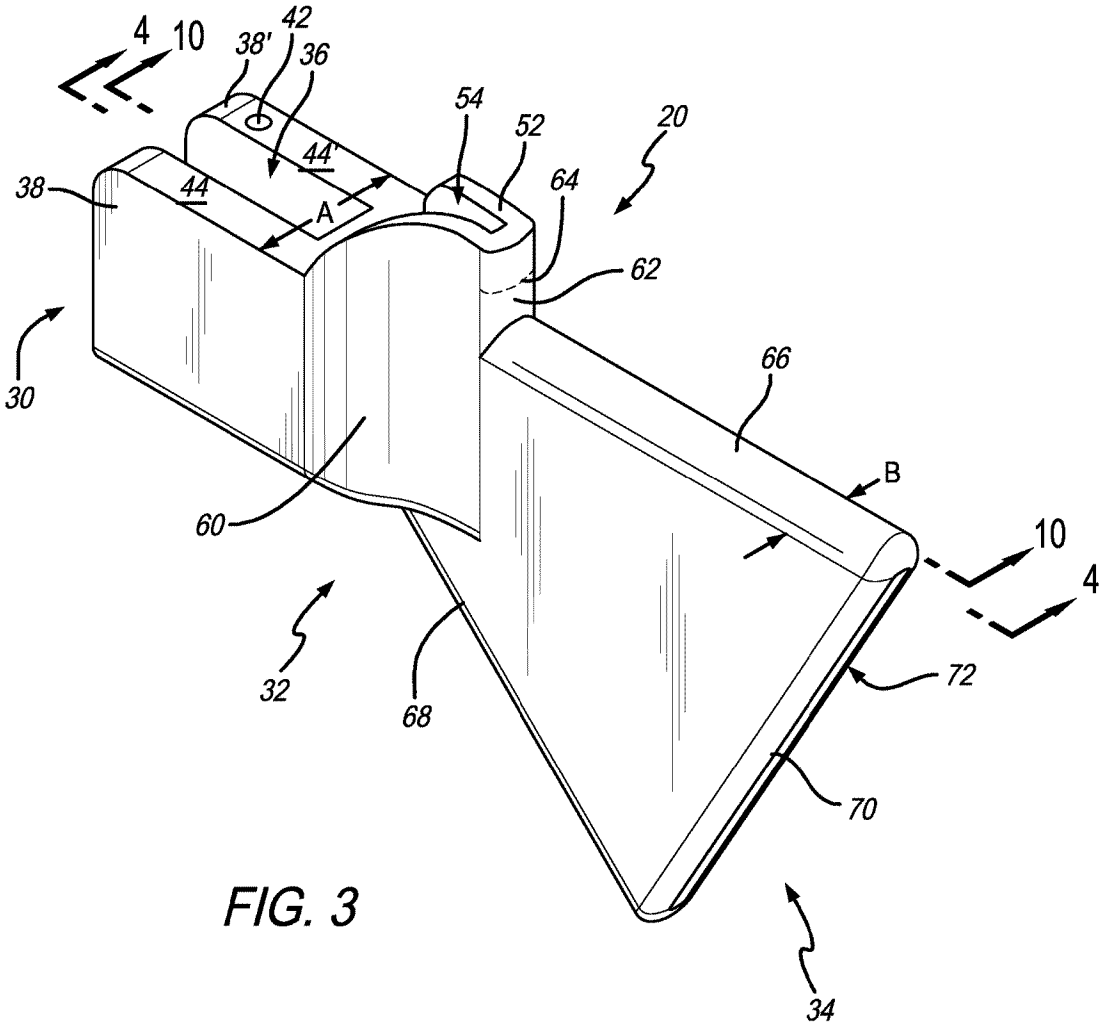
FIG. 3 is a perspective view illustrating the rear, top and right sides of the firearm grip as disclosed herein.

As shown in more detail in the perspective view of FIG. 3, the firearm grip 20 generally includes a forward or front section 30 that selectively removably couples with the receiver assembly 24 and a transition 32 that generally decreases the width of the firearm grip 20 from the relatively wider front section 30 to a relatively thinner and generally rearwardly projecting handle 34. In this respect, the front section 30 has a width defining a thickness illustrated as feature "A", which is relatively larger than a width defining a thickness illustrated as feature "B" along the handle 34 in FIGS. 3, 8, and 9.

Figure 6:
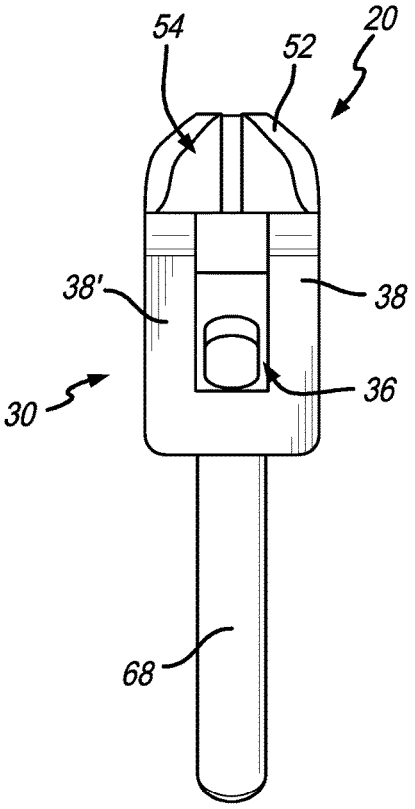
FIG. 6 is a front elevation view of the firearm grip as disclosed herein.

More specifically, the thickness "A" illustrated in FIGS. 3 and 6 is suitable for forming a slot 36 therein, which naturally forms a pair of lateral guides 38, 38' on each side. In this respect, the slot 36 has a size and shape for select slide-on reception onto a downwardly protruding flange 40 of the receiver assembly 24, which is shown in exploded relation relative to one another in FIG. 2. When the firearm grip 20 couples with the rifle 22, the flange 40 may reside flush within the slot 36, and each of the lateral guides 38, 38' may thereafter prevent side-to-side movement of the firearm grip 20 relative to the rifle 22 by way of enclosing in and around the flange 40.

Figure 4:
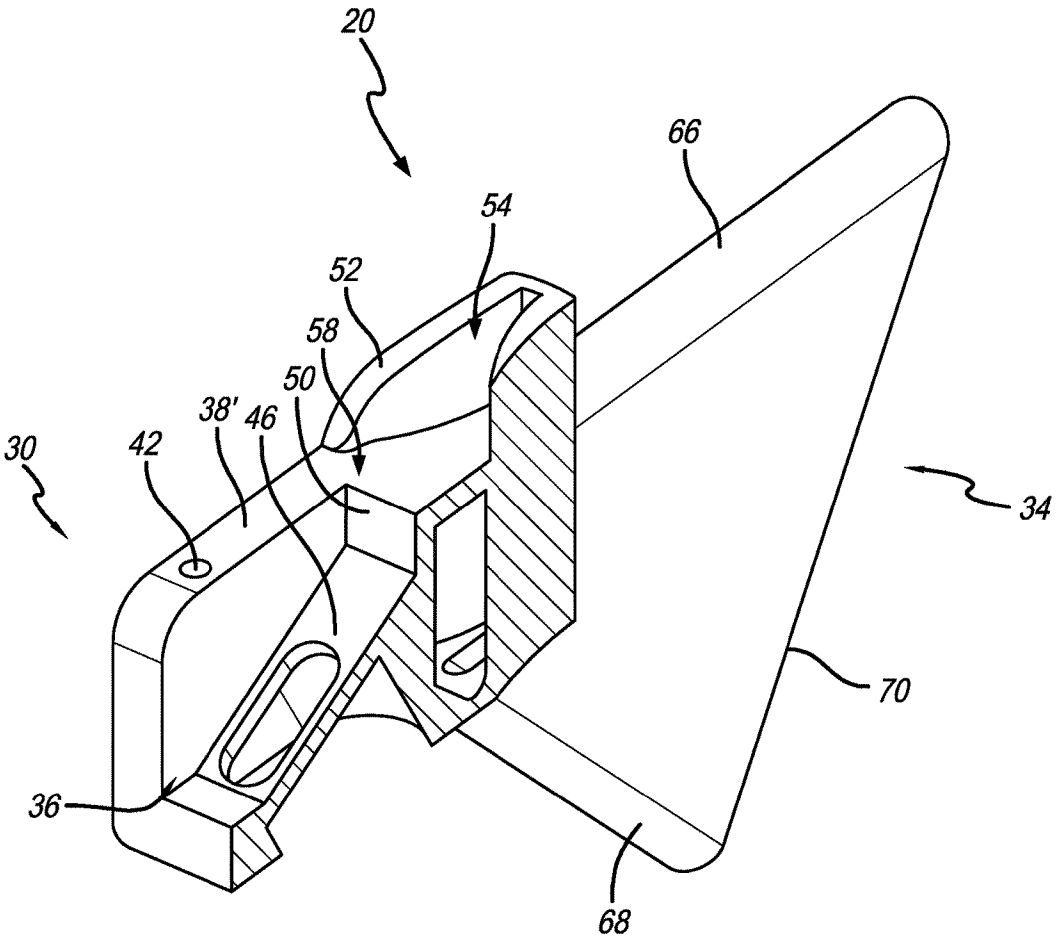
FIG. 4 is a partial cross-sectional view of the firearm grip taken about the line 4-4 in FIG. 3.
Figure 5:
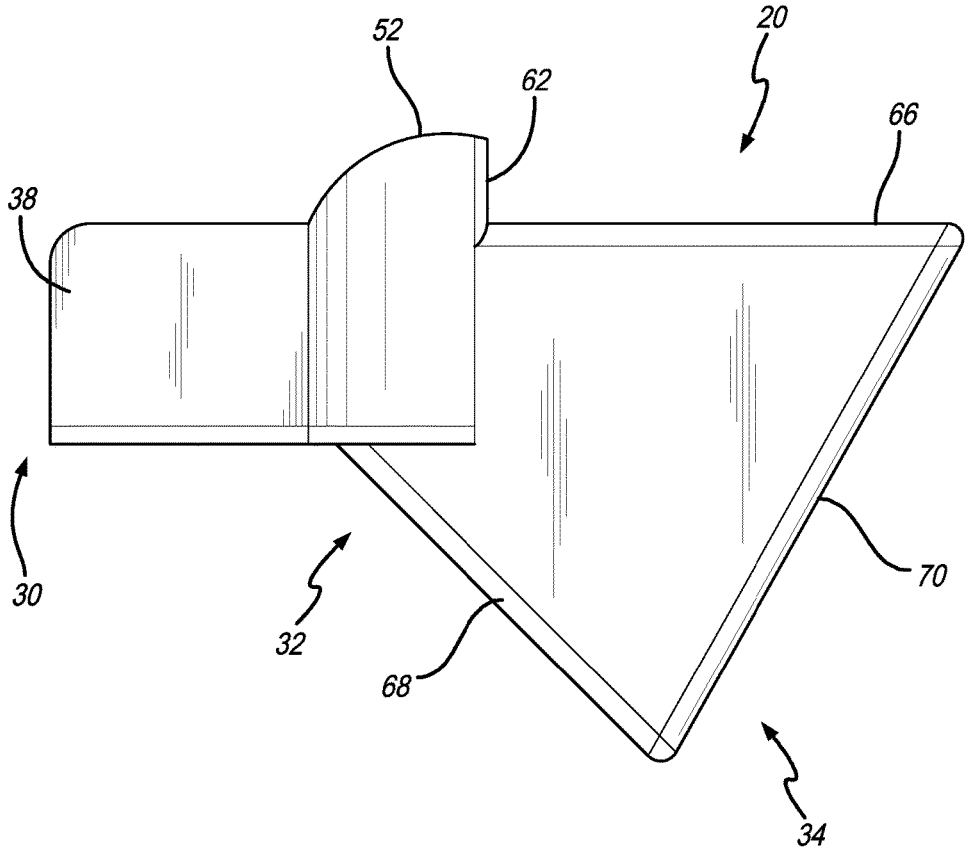
FIG. 5 is a right side elevation view of the firearm grip as disclosed herein.
Figure 8:
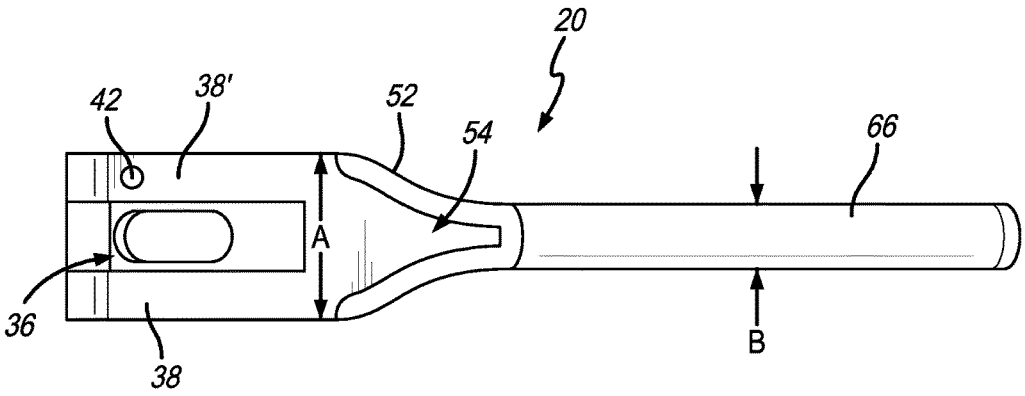
FIG. 8 is a top plan view of the firearm grip as disclosed herein.

The firearm grip 20 may securely attach to the receiver assembly 24 by way of a threaded fastener (not shown), such as a screw, bolt, or the like. Here, as illustrated in FIGS. 3, 4, and 8, the lateral guide 38' includes an aperture 42 formed into a top surface 44' of the front section 30 and includes a size and shape for select reception and threaded retainment therein of the threaded fastener. The threaded fastener may first insert through a portion of the receiver assembly 24 for top-down insertion into the aperture 42 in the lateral guide 38'. As such, through threaded engagement, the threaded fastener secures or fastens the firearm grip 20 to the rifle 22. Although, in alternative embodiments, the front section 30 may include more than the single aperture 42. For example, each of the lateral guides 38, 38' may include one (or more) of the apertures 42 configured for select engagement with a respective threaded fastener that first inserts into the receiver assembly 24, to more securely tighten the firearm grip 20 on each side of the rifle 22. In alternative embodiments, the threaded fastener may extend through the height of one or more of the lateral guides 38, 38' for bottom-up engagement therewith. Here, the threaded fastener may threadingly engage the receiver assembly 24 as opposed to within the aperture 42.

FIG. 4 more specifically illustrates the internal construction of the slot 36. As shown, the slot 36 may include an angled platform 46 that selectively slides onto a complimentary or keyed angled base 48 (FIG. 2) of the receiver assembly 24. The firearm grip 20 may further include a stop 50 in the form of a substantially vertical shelf designed to terminate slide-on engagement with the flange 40 when the firearm grip 20 has engaged the receiver assembly 24 by the appropriate or desired distance. As such, when fully engaged to the stop 50, the aperture 42 may align with a similar aperture or the like (not shown) in the receiver assembly 24 for engagement therewith by the aforementioned fastener, as described above. Here too the firearm grip 20 may include an upstanding collar 52 that generally tracks the width of the firearm grip 20, including as the firearm grip 20 transitions from the width or thickness "A" in about the front section 30 to the width or thickness "B" defined by the handle 34. Specifically, as best shown in FIGS. 3, 4, and 8, the collar 52 forms an enclosure 54 that may snugly fit in around or hug a rearwardly facing upper curvature 56 (FIG. 2) of the receiver assembly 24. A step 58 (FIG. 4) formed by the transition between the stop 50 and the enclosure 54 may further facilitate keyed engagement of the firearm grip 20 with the receiver assembly 24 of the rifle 22 to stabilize forward/rearward and side-to-side movement thereof.

As shown best in FIG. 3, the transition 32 includes a taper or curved outer wall 60 that generally decreases the width or thickness "A" of the front section 30 into the relatively smaller or thinner width or thickness "B" of the handle 34. In this respect, the generally upstanding collar 52 may track the curvature of the curved outer wall 60 along the transition 32 while simultaneously maintaining its thickness, as best shown in FIGS. 6 and 8. Thus, as illustrated in FIGS. 3, 6, and 8, the collar 52 may generally extend inwardly into a "V"-shaped formation that forms the aforementioned enclosure 54 that hugs or pinches inwardly against the rearwardly facing upper curvature 56 of the receiver assembly 24. The collar 52 may terminate in a generally upstanding hand stop 62 that provides a rest or stop to prevent forward movement of the V-shape of the hand formed between the webbing of the index finger and thumb. Here, the upstanding hand stop 62 may include a filleted or rounded surface to enhance comfort during use. Moreover, a generally invisible line of demarcation 64 extending across the upstanding hand stop 62 denotes the approximate location where a top opening of the trigger well of the rearwardly facing upper curvature 56 of the receiver assembly 24 is located.

Accordingly, as briefly mentioned above, the curved outer wall 62 terminates into the generally rearwardly extending handle 34 having a relatively consistent width or thickness "B" relatively thinner than the width or thickness "A" of the front section 30. Similar to the upstanding hand stop 62, the handle 34 may include a filleted or rounded upper edge 66 for added comfort during use. Additionally, the handle 34 illustrated in FIG. 3 is of a generally triangular shape (e.g., best shown in the side view of FIG. 5), including a bottom edge 68 extending down and away from the transition 60 and eventually transitioning into an upwardly and outwardly extending rear edge 70 that eventually transitions back in toward the transition 32 by way of the upper edge 66. Although, the handle 34 could be any shape known in the art. As such, the relatively narrow thickness of the handle 34 allows the webbing of the hand to sit higher than the opening 26 of the trigger well while reducing unnecessary pressure on the ball of the hand. Moreover, the firearm grip 20 allows the index finger and thumb to make a V-shape along the upstanding hand stop 62, which allows holding the firearm grip 20 more ergonomically.

Figure 7:
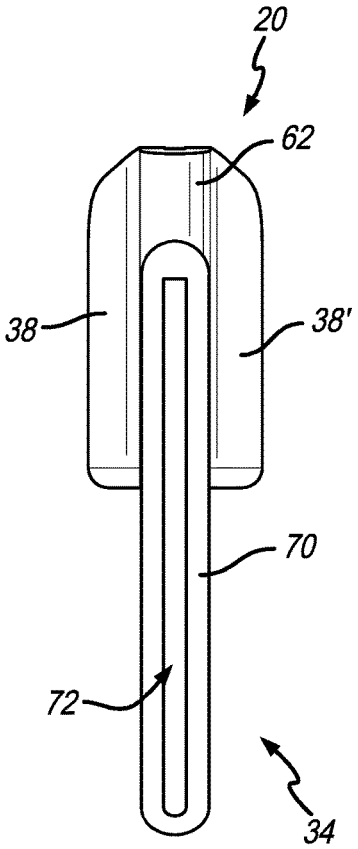
FIG. 7 is a rear elevation view of the firearm grip as disclosed herein.
Figure 9:
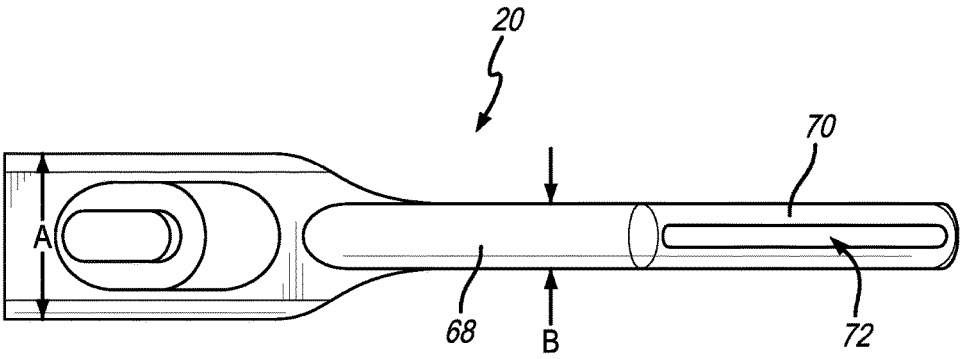
FIG. 9 is a bottom plan view of the firearm grip as disclosed herein.
Figure 10:
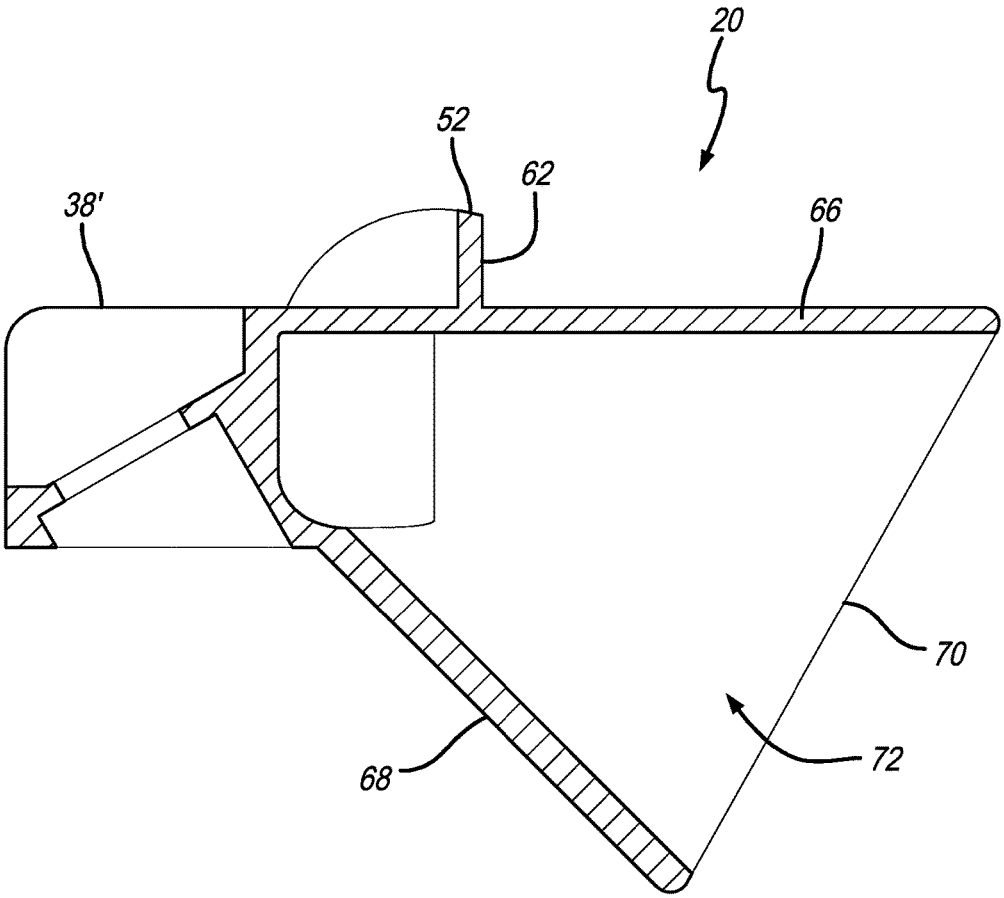
FIG. 10 is a cross-sectional view of the firearm grip taken about the line 10-10 in FIG. 3, illustrating a hollow interior.
Figure 11:
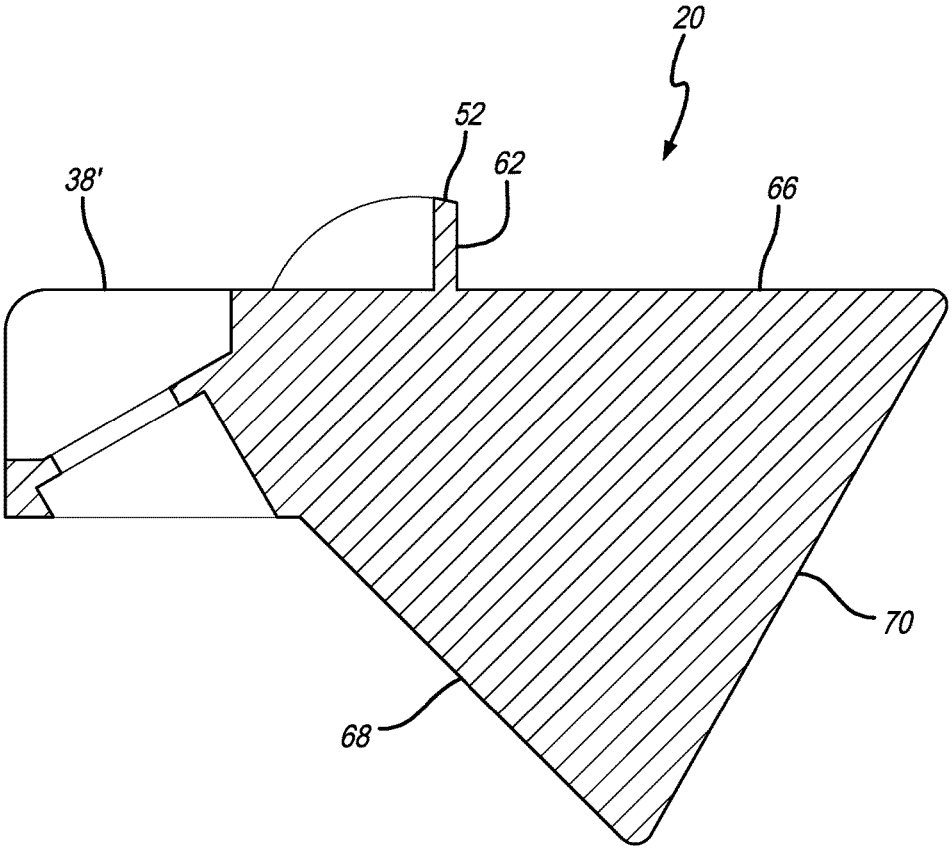
FIG. 11 is a cross-sectional view similar to FIG. 9, illustrating an alternative embodiment of a solid interior.

The firearm grip 20 may generally be constructed from a plastic-based material and may be made, e.g., by way of an injection molding process. Although, of course, in alternative embodiments, the firearm grip 20 may be made from other materials known in the art, such as being forged from a metal material. As illustrated in FIGS. 3,7, and 9, and in more detail with respect to the cross-sectional view of FIG. 10, the handle 34 may include a hollow chamber 72 to reduce the weight of the firearm grip 20. The hollow chamber 72 may be made as part of a plastic molding process and to save on materials. In this respect, two separately molded halves (such as represented in the cross-sectional view of FIG. 10) may then be sonically welded together to form a single firearm grip 20. The surface of the firearm grip 20 not directly in contact with the receiver assembly 24 may be covered in a rubber-based compound to increase grip and comfort. Although, in alternative embodiments, the firearm grip 20 may include a solid handle 34, such as the one illustrated in the cross-sectional view of FIG. 11, and may have a unitary construction.

While the handle 34 is illustrated in FIGS. 1-11 having a generally consistent thickness or width, in alternative embodiments, the handle 34 may include a relatively thinner or reduced thickness toward the upper edge 66 and then generally expand downwardly toward the bottom edge 68 and/or the rear edge 70 to provide a larger finger grip surface area. Such an embodiment may improve grip, yet attain the benefits of reducing pressure on the palm near the upper edge 66 resulting from gripping the upper edge 66 during use, especially in relation to prior art firearm grips.

Although several embodiments have been described in detail for purposes of illustration, various modifications may be made without departing from the scope and spirit of the invention. Accordingly, the invention is not to be limited, except as by the appended claims.

What is claimed is:

1. A firearm grip, comprising:

a front section having a width forming a connection assembly comprising a slot positioned between a pair of laterally extending guides, the connection assembly having a size and shape for select removable coupling with a portion of a firearm;

a handle extending rearwardly relative to the front section and including an upper palm receiving edge positioned above an opening of a trigger guard of the firearm when the firearm grip is selectively coupled thereto, the handle having a thickness relatively thinner than the width of the front section; and a tapered transition positioned between the front section and the handle, the tapered transition generally decreasing the width of the front section to the relatively thinner thickness of the handle.

2. The firearm grip of claim 1, wherein during slotted engagement of the firearm grip with the firearm, the pair of lateral guides sandwich a downwardly extending flange of the firearm within the slot and cooperate therewith to prevent side-to-side movement of the firearm grip relative to the firearm.

3. The firearm grip of claim 1, wherein at least one of the pair of lateral guides includes a threaded aperture having a size and shape for select threaded engagement with a fastener for securing the firearm grip to the firearm.

4. The firearm grip of claim 1, wherein the slot includes an internally positioned angled platform for select ramp-up engagement with a keyed base of the firearm.

5. The firearm grip of claim 4, wherein the angled platform terminates internally within the slot into a generally vertically positioned stop positioning the firearm grip in flush relation relative to the firearm.

6. The firearm grip of claim 1, including an upstanding collar vertically positioned above the upper palm receiving edge of the handle.

7. The firearm grip of claim 6, wherein the upstanding collar includes an outer wall flush with an outer wall of the front section, the tapered transition, and the relatively thinner thickness of the handle.

8. The firearm grip of claim 7, wherein the collar comprises a relatively consistent wall thickness.

9. The firearm grip of claim 6, wherein opposite sides of the upstanding collar proximate the front section start in spaced relation relative to one another and extend rearwardly and inwardly and terminate in a common point thereby forming a general V-shaped enclosure.

10. The firearm grip of claim 9, wherein the common point forms a generally upstanding hand stop positioned vertically above the upper palm receiving edge of the handle.

11. The firearm grip of claim 1, wherein an outer wall of the tapered transition comprises a curved outer wall generally decreasing in size from the width of the front section to the relatively thinner thickness of the handle.

12. The firearm grip of claim 1, wherein the upper palm receiving edge includes a filleted surface.

13. The firearm grip of claim 1, wherein the handle comprises a solid handle.

14. A firearm grip, comprising:

a front section having a width forming a connection assembly having a size and shape for select coupling with a firearm;

a handle having a thickness relatively thinner than the width of the front section and extending rearwardly therefrom;

a tapered transition positioned between the front section and the handle and including a curved outer wall generally decreasing the width of the front section to the relatively thinner thickness of the handle; and an upstanding collar vertically positioned above a palm receiving edge of the handle and including an outer wall flush with an outer wall of the front section, flush with the curved outer wall of the tapered transition, and flush with an outer wall of the relatively thinner thickness of the handle.

15. The firearm grip of claim 14, wherein the connection assembly includes a slot having an angled platform positioned between a pair of laterally extending guides that sandwich a downwardly extending flange of the firearm within the slot and cooperate therewith to prevent side-to-side movement of the firearm grip relative to the firearm when coupled thereto.

16. The firearm grip of claim 15, wherein the angled platform terminates internally within the slot into a generally vertically positioned stop positioning the firearm grip in keyed flush relation relative to the firearm to align a threaded aperture within at least one of the pair of lateral guides with the firearm for select reception and coupling thereto by a threaded fastener.

17. The firearm grip of claim 14, wherein the handle comprises a solid handle and the upper palm receiving edge includes a filleted surface.

18. The firearm grip of claim 14, wherein opposite sides of the upstanding collar proximate the front section start in spaced relation relative to one another and extend rearwardly and inwardly and terminate in a common point forming a generally upstanding hand stop vertically positioned above the upper palm receiving edge of the handle.

19. The firearm grip of claim 14, wherein the upper palm receiving edge is positioned above an opening of a trigger guard of the firearm when the firearm grip is selectively coupled thereto.

20. A firearm grip, comprising:

a front section having a width forming a connection assembly comprising a slot having an internally positioned angled platform for select ramp-up engagement with a keyed base of a firearm positioned between a pair of laterally extending guides, one of which includes a threaded aperture having a size and shape for select threaded engagement with a fastener; and a solid handle extending rearwardly relative to the front section and including an upper palm receiving edge positioned above an opening of a trigger guard of the firearm when the firearm grip is selectively coupled thereto, the handle having a thickness relatively thinner than the width of the front section.

21. The firearm grip of claim 20, wherein during slotted engagement of the firearm grip with the firearm, the pair of lateral guides sandwich the keyed base within the slot and cooperate therewith to prevent side-to-side movement of the firearm grip relative to the firearm and the angled platform terminates internally within the slot into a generally vertically positioned stop positioning the firearm grip in flush relation relative to the firearm.

22. The firearm grip of claim 20, including an upstanding collar having a relatively consistent wall thickness vertically positioned above the upper palm receiving edge of the handle and having an outer wall flush with an outer wall of the front section and the relatively thinner thickness of the handle, wherein opposite sides of the upstanding collar proximate the front section start in spaced relation relative to one another and extend rearwardly and inwardly and terminate in a common point thereby forming a general V-shaped enclosure.

23. The firearm grip of claim 20, including a tapered transition having a curved outer wall generally decreasing in size from the width of the front section to the relatively thinner thickness of the handle.

* * * * *